US006050410A

United States Patent [19]

Quirion

[11] Patent Number: 6,050,410

[45] Date of Patent: Apr. 18, 2000

[54] FOLDABLE PALLET-MOUNTED CONTAINER

[76] Inventor: M. Yvan Quirion, 66 Rue Veillette, Saint-Constant Québec, Canada, J5A 1P3

[21] Appl. No.: 09/153,876

[22] Filed: Sep. 15, 1998

[30] Foreign Application Priority Data

Jan. 11, 1998 [CA] Canada ..... 2240369

[51] Int. Cl.[7] ..... B65D 19/00; B65D 5/36

[52] U.S. Cl. ..... 206/386; 206/600; 229/117.05; 229/122.28; 229/117.02

[58] Field of Search ..... 206/386, 595, 206/596, 597, 598, 599, 500; 229/117.05, 117.06, 117.07, 117.02, 122.28, 122.21, 125.19

[56] References Cited

U.S. PATENT DOCUMENTS

| | | | |
|---|---|---|---|
| 4,373,637 | 2/1983 | Shippell | 206/600 |
| 4,606,461 | 8/1986 | Bolton, Sr. | 206/386 |
| 4,793,507 | 12/1988 | Delplanque | 206/600 |
| 4,949,898 | 8/1990 | Nederveld | 229/117.02 |
| 5,934,474 | 8/1999 | Renninger et al. | 206/600 |

*Primary Examiner*—M. D. Patterson
*Assistant Examiner*—J. Mohandesi
*Attorney, Agent, or Firm*—Mario D. Theriault

[57] ABSTRACT

A foldable pallet-mounted container comprising a shallow base mounted on a pallet, a foldable box mounted inside the shallow base, and a flanged cover having overall dimensions to fit over the shallow base for covering the shallow base when the foldable box is folded inside the shallow base, and for covering the foldable box when the foldable box is deployed. The shallow base is made of corrugated board and comprises a horizontal planar member and single-pleated uprising side members connected along a pair of opposite edges of the planar member. Each uprising side member has a reinforcing flap member connected thereto and overlapping the horizontal planar member. The foldable box is also made of corrugated board, and comprises first and second opposite side panels and first and second opposite end panels and a liner member connected to the horizontal planar member of the shallow base and to the first end panel. The foldable box is movable from a stowed mode to a deployed mode about a crease formed at the intersection of the liner member and the first end panel.

20 Claims, 9 Drawing Sheets

FOLDABLE PALLET-MOUNTED CONTAINER

FIELD OF THE INVENTION

This invention pertains to foldable pallet-mounted containers and more particularly, the present invention pertains to foldable pallet-mounted paperboard boxes that have shallow bases for reinforcing the lower perimeter thereof during use and for protecting the folded boxes during shipment and storage.

BACKGROUND OF THE INVENTION

Foldable pallet-mounted containers are used for shipping a variety of goods such as bulk material in aggregate, fibrous or powdery form, food in bags or pouches, commodities packed in small boxes and loose components used in assembly lines. Paperboard pallets and containers are generally preferred by the environment-conscious users, because this material is entirely recyclable. Corrugated paperboard material, however, is not as durable as wood, composite materials or metal, and the design of a container made with it requires additional ingenuity to ensure that the useful life of the container will be comparable or superior to the duration of those made with the conventional materials.

A first example of a foldable pallet-mounted container of the prior art is illustrated and described in U.S. Pat. No. 4,383,609 issued on May 17, 1983 to Eugene C. Lochmiller. The container of this invention comprises a corrugated cardboard base which is built into a wooden pallet, and a rectangular corrugated cardboard sleeve which is adapted to slide over the base and to vertically interlock with the base. A cover member fits over the rectangular sleeve to form with the sleeve and the base, a closed container integrally mounted to a wooden pallet.

In a second example of a foldable container of the prior art, U.S. Pat. No. 4,927,026 issued on May 22, 1990 to Haas K. Gossler and Charles P. Roberts, discloses a corrugated cardboard box affixed to a wooden pallet. The box is made of two parts. The first part comprises a floor and four vertically extending flaps. The second part is a rectangular tubular member that fits over the four flaps, thereby forming a double layered container.

Another type of collapsible corrugated board container is described in U.S. Pat. No. 5,318,219 issued on Jun. 7, 1994 to Glenn M. Smith. In this invention, an integral corrugated cardboard box is stapled to a pallet and is foldable in a compact flat form. The bottom portion of the box is foldable over itself to allow opposite sides of the box to lay parallel over top of one another.

A further example of a foldable container is described in U.S. Pat. No. 5,441,154 issued on Aug. 15, 1995 to Donald R. Youell, III. The paperboard container and pallet system described therein comprises a shallow deck portion mounted on hollow cardboard runners, a wall-forming portion and a cover. The wall-forming portion has locking tabs on its lower edge, and these tabs are adapted to lock into matching slots through the deck portion and the hollow runners. Notches are provided in the hollow runners for selectively releasing the locking tabs from the deck portion and refolding the wall-forming portion of the container into the deck portion.

It is believed that a first preferred requirement by the industry regarding foldable pallet-mounted containers is that the wall forming portion should be an integral part of the base portion such that the box portion is inseparable from the base portion throughout the life of the container. A second preferred requirement by the industry is believed to be that the container should be foldable without having to manipulate the pallet, or otherwise reach under the pallet and into intricate cavities to undo locking tabs. Similarly, it is believed that a third preferred requirement by the industry is that the deployed container has sufficient strength for resisting lateral internal pressure associated with a loading thereof with heavy granular material for example. Finally, another preferred requirement by the industry is believed to be that the corrugated board container is securely foldable to avoid damages during transport back to the original filler.

The foldable containers of the prior art are believed to be deficient at least one of the above preferred requirements, and it is this reason basically that has contributed to the development of a market demand for better foldable containers capable of resisting the loading of a variety of products and in particular, that can be used for a relatively large number of shipping-returning cycles.

SUMMARY OF THE INVENTION

In the present invention, however, there is provided a foldable pallet-mounted container that is easy to deploy and to fold down without instructions, that has stiffening members to provide strength against lateral internal loading caused by granular or similar loose loads, and that is sturdy enough to resist the stresses of several ship and return cycles.

In accordance with a first aspect of the present invention, there is provided a foldable pallet-mounted container comprising a shallow base mounted on a pallet, a foldable box mounted inside the shallow base, and a flanged cover having overall dimensions to fit over the shallow base, for covering the shallow base when the foldable box is folded inside the shallow base, and for covering the foldable box when the foldable box is deployed.

The shallow base is made of corrugated board material and comprises a horizontal planar member having four straight edges defining four right angle comers. The shallow base also comprises a pair of single-pleated uprising side members connected to and along a pair of opposite edges of the planar member. Each uprising side member has a reinforcing flap member connected thereto and overlapping the horizontal planar member. The foldable box is also made of corrugated board material, and comprises first and second side panels and first and second end panels and a first liner member connected to the horizontal planar member of the shallow base and to the first end panel. The pallet is made of a plurality of runners and a plurality of rails affixed to the runners in a perpendicular relation therewith, the runners and rails are made of laminated strips of corrugated board.

A primary advantage of the above-described structure is that when the foldable box is deployed, the side and end panels of the box are retainable between the uprising side members of the shallow base and inside the flanged cover for resisting horizontal shear stresses producible by a content of the foldable box.

Another advantage of this structure is that when the foldable box is folded inside the shallow base and cover, the foldable box is protectable against the shearing, tearing and crushing stresses normally associated with the handling and storing of foldable containers, especially when the foldable containers are handled or piled in stacks.

In accordance with another aspect of the present invention, there is provided a foldable container comprising a shallow base made of corrugated board and having a horizontal planar member having four straight edges defining four right angle comers. The shallow base also has first and second pairs of single-pleated uprising side members connected to and along corresponding pairs of opposite straight edges of the horizontal planar member, and a template member laid over the horizontal planar member and defining with three of the uprising side members a recess bordering the horizontal planar member. The foldable container of this aspect of the present invention also comprises a foldable box mounted inside the shallow base. The foldable box is also made of corrugated board. The foldable box has first and second side panels and first and second end panels and a first liner member connected to the horizontal planar member of the shallow base and to the first end panel. Each of the first and second side panels and second end panel has a lower edge and a nominal thickness, this nominal thickness is less than a width of the recess such that when the foldable box is deployed, the lower edges of the foldable box are securable in the recess for retaining the foldable box in a deployed mode.

The foldable container of the present invention is easily operable from a folded mode to a deployed mode by a user standing beside the container, without having to reach under or otherwise manipulate the base of the container. The operation of the container of the present invention is understandable in a glance and written instruction to a first user are normally not required.

In accordance with yet another aspect of the present invention, the foldable container and the foldable pallet-mounted container of the present invention are entirely made of corrugated board material joined with adhesive. These constructions do not contain staple or other metal or plastic fastener. The adhesive used in the manufacture of the foldable containers and pallets is a water-based pulpal glue. Therefore, the foldable containers and pallets of the present invention are entirely recyclable after their useful life.

The foldable pallet-mounted container and the foldable container of the present invention are further more durable than the foldable pallet-boxes of the prior art. Experience has shown that some of the pallet-boxes of the prior art are usable only for 1–2 ship-return cycles, wherein the foldable pallet-mounted containers of the preferred embodiments have averaged in many instances, up to 6–7 ship-return cycles before being replaced.

BRIEF DESCRIPTION OF THE DRAWINGS

Other advantages of the invention will be apparent from the following description of the preferred embodiments illustrated in the accompanying drawings, in which.

DETAILED DESCRIPTION OF THE PREFERRED EMBODIMENT

Figure 1:
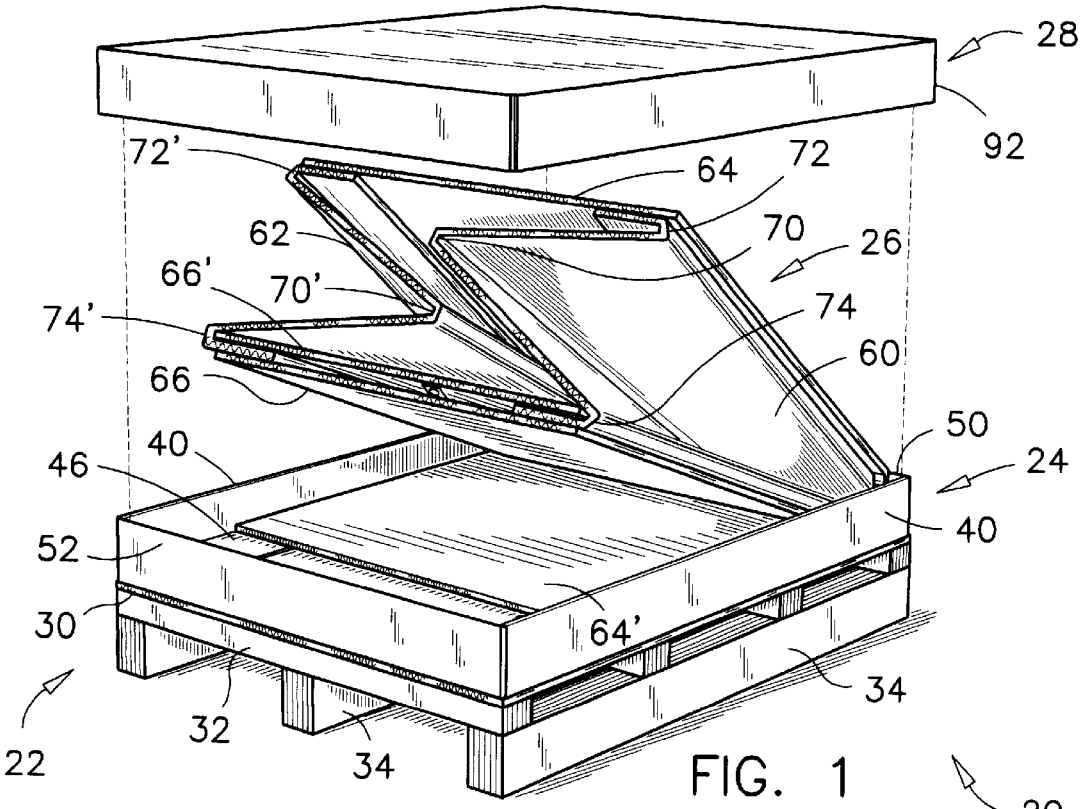
FIG. 1 is a perspective view of the foldable pallet-mounted container of the first preferred embodiment showing the container in a partly folded position and the cover thereof in an exploded view mode above the container.
Figure 2:
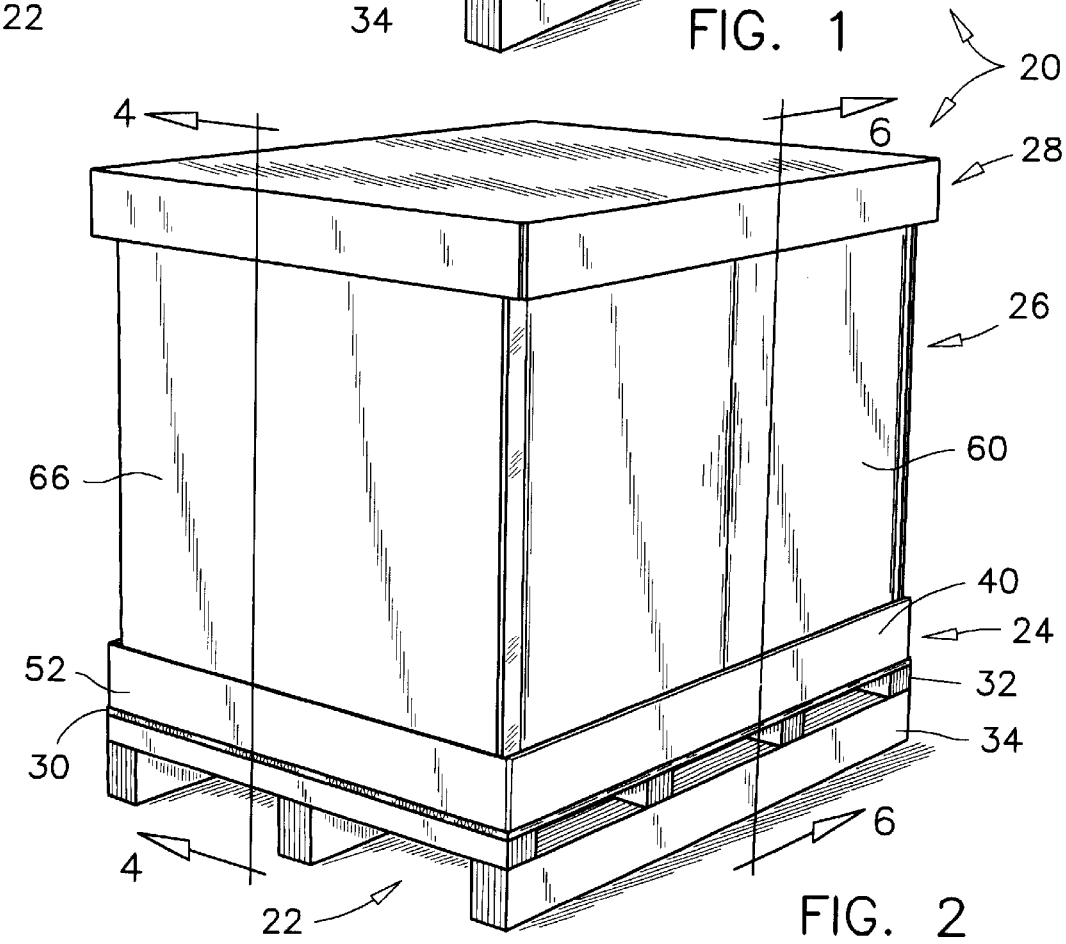
FIG. 2 is a perspective view of the foldable pallet-mounted container of the first preferred embodiment showing the container in a fully deployed and usable mode.

The foldable pallet-mounted container 20 of the first preferred embodiment is illustrated in a partially folded mode in FIG. 1, and in a deployed mode in FIG. 2. The foldable pallet-mounted container 20 comprises broadly; a pallet 22, a shallow base 24 mounted on the pallet 22, a foldable box 26 mounted inside the shallow base 24, and a flanged cover 28 for covering the shallow base 24 when the foldable box 26 is folded inside the shallow base, or for covering the upper side of the foldable box 26 when the foldable box is fully deployed.

The pallet 22 is made of a double-ply corrugated board top planar member 30; a plurality of transversally extending laminated multi-ply corrugated board runners 32 equally spaced and glued to the underside of the top planar member 30; and a plurality of laminated multi-ply corrugated board rails 34 glued perpendicularly to and under the runners 32.

The runners 32 are preferably aligned perpendicularly to the corrugations in the top planar member 30, and the corrugations in the runners 32 and rails 34 are preferably aligned vertically when the pallet is in use. The runners 32 are aligned along a transversal orientation of the foldable pallet-mounted container 20 of the first preferred embodiment, and the rails 34 are aligned along a longitudinal orientation thereof. The runners 32 and rails 34 each preferably comprises about eighteen to twenty (18–20) plies of corrugated board.

The shallow base 24 of the foldable pallet-mounted container 20 of the first preferred embodiment is made of single-ply corrugated board and is glued to the top planar member 30 of the pallet 22. The single-ply board of the shallow base 24 is folded to form a shallow receptacle having the sides extending at a height 'A' of about 4-¾ inches (12 cm) above the top planar member 30.

Figure 8:
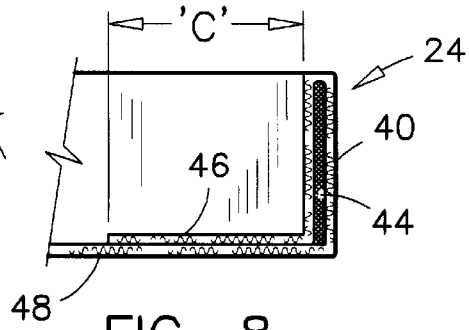
FIG. 8 is an enlarged cross-section view of the forming of the shallow base of the foldable pallet-mounted container of the first preferred embodiment as seen in detail circle 8 in FIG. 6.
Figure 10:
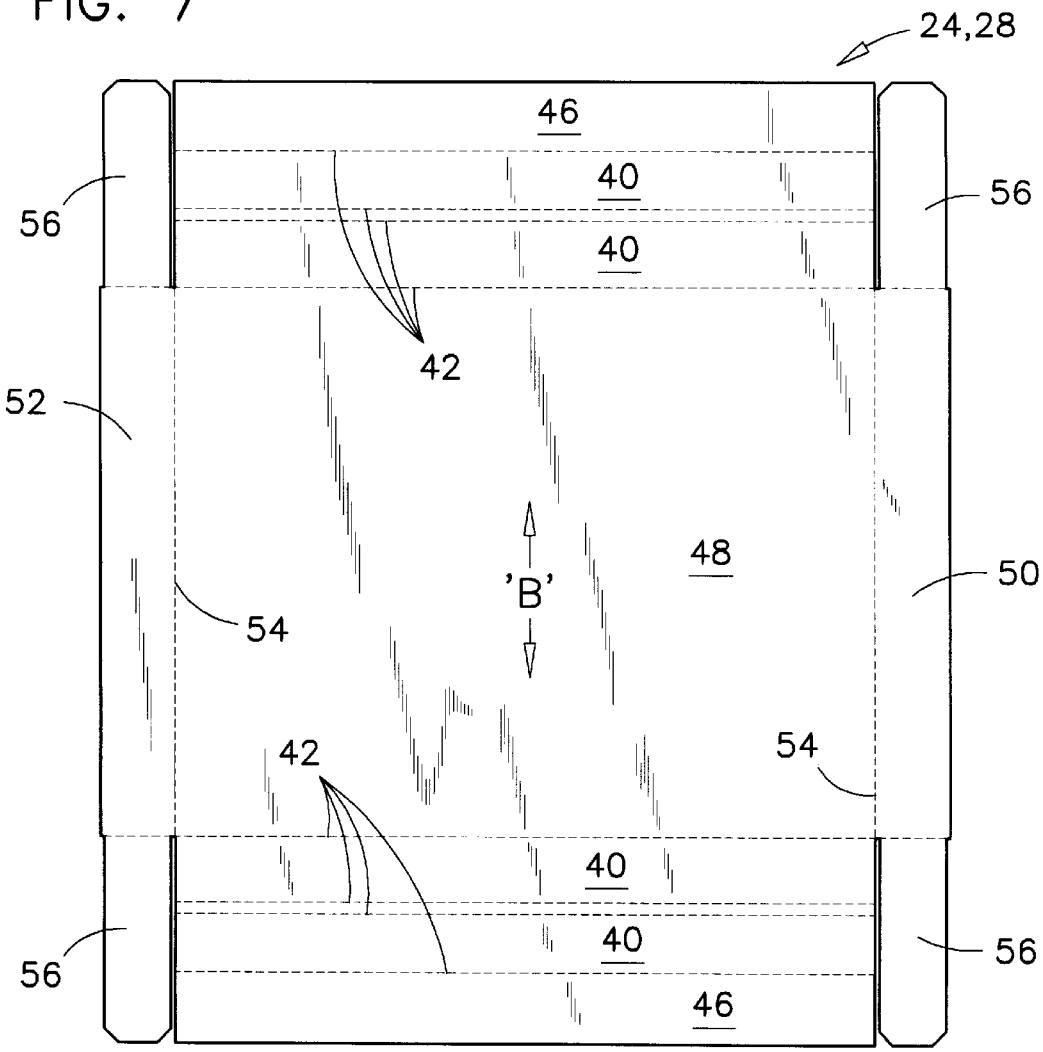
FIG. 10 is a flat pattern of the shallow base of the foldable pallet-mounted container of the first preferred embodiment.
Figure 11:
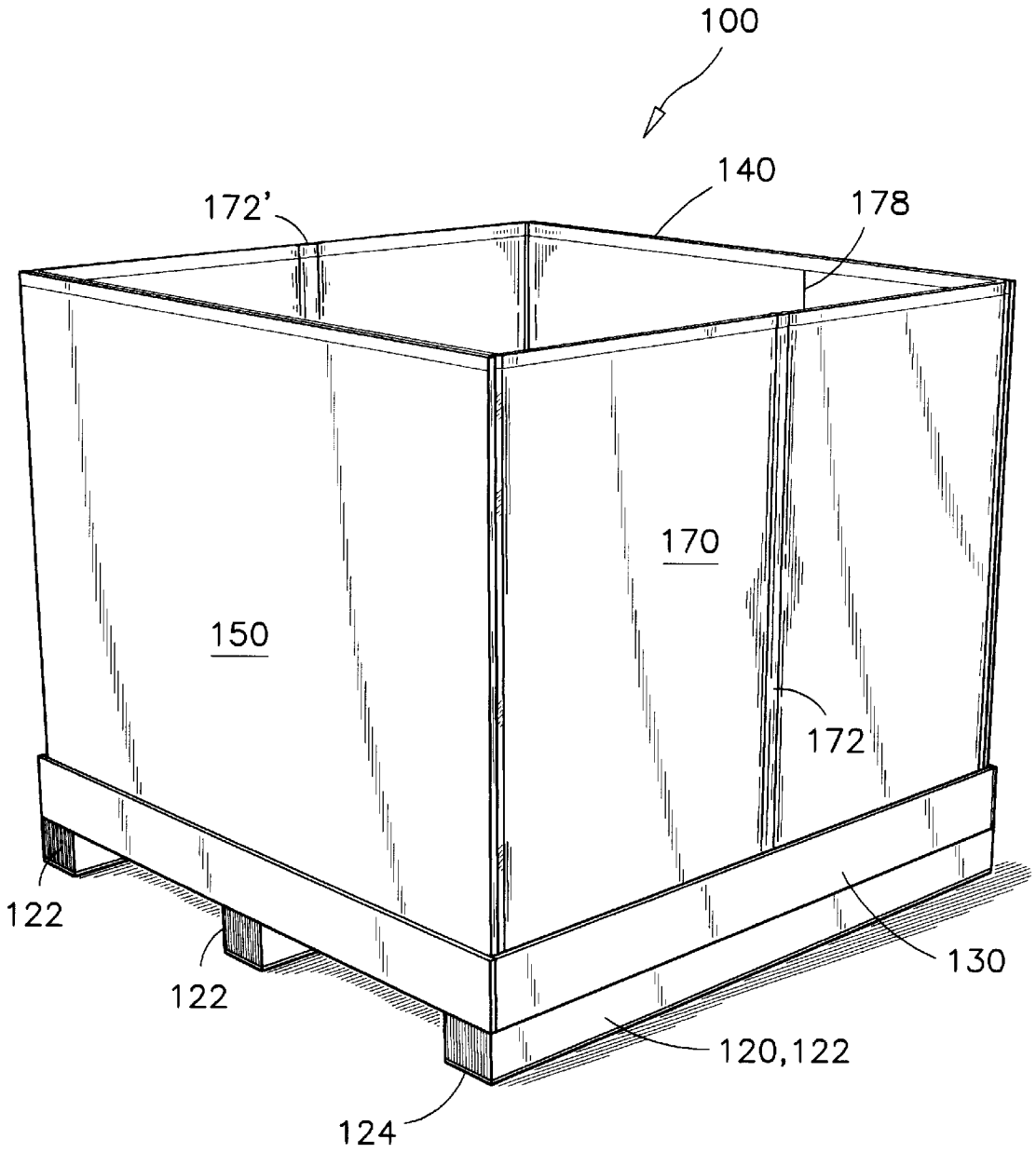
FIG. 11 is a perspective view of the foldable pallet-mounted container of the second preferred embodiment without a flanged cover.
Figure 12:
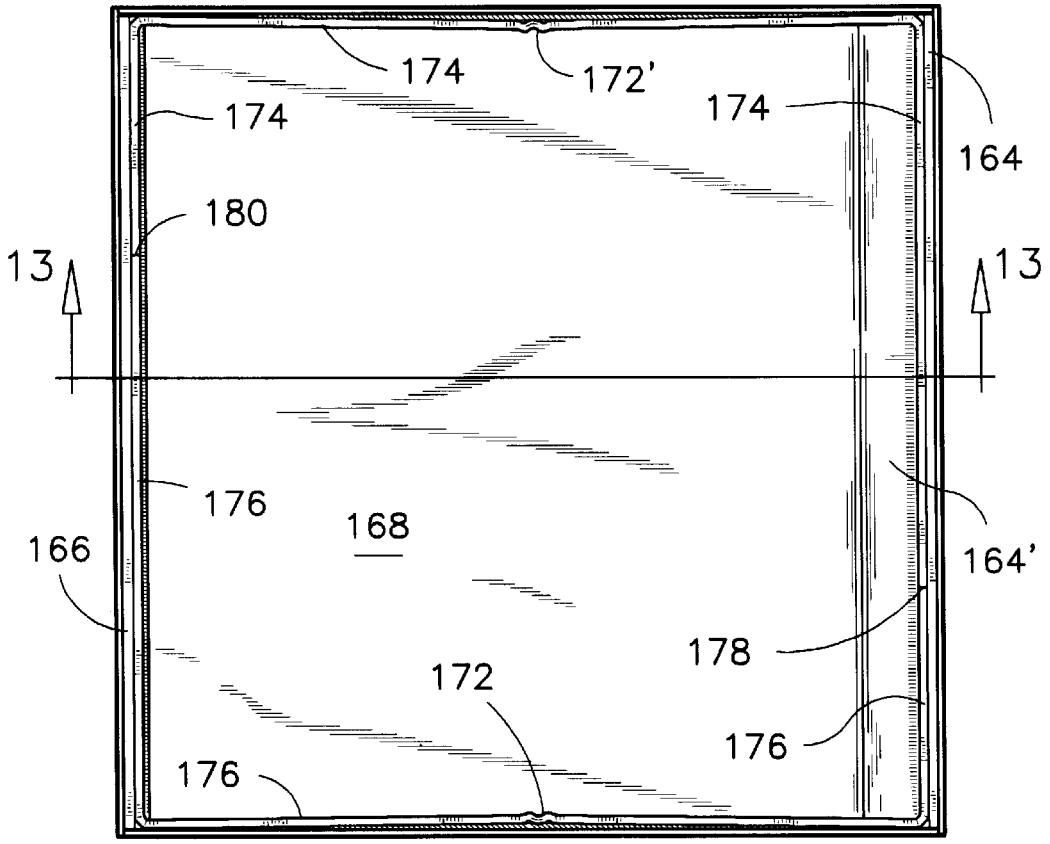
FIG. 12 is a plan view of the foldable pallet-mounted container of the second preferred embodiment.

The corrugations in the shallow base 24 are aligned transversally relative to the foldable container 20, as indicated by label 'B' in FIG. 10. The uprising side members 40 of the shallow base 24 as illustrated in FIGS. 8 and 10, are folded along bend lines 42 to form a single pleat 44 having a reinforcing flap member 46 overlapping and being glued to the bottom surface 48 of the shallow base 24. The width 'C' of the reinforcing flap member 46 is preferably about 4-¾ inches (12 cm). The uprising end members 50,52 of the shallow base 24 are made of a single-ply planar member and are bent along bend lines 54 as illustrated in FIG. 10. The end members 50,52 each has at each end thereof, a tab 56 the length of which extends the full flat width of the single-pleated uprising side member 40 and the width of the flap member 46. Upon forming the shallow base 24, each tab 56 is tucked inside the pleat 44 in a respective end of an uprising side member 40 for reinforcing each corner of the shallow base 24.

The structure of the flanged cover 28 is identical to the structure of the shallow base 24 except that the inside dimensions of the cover 28 are slightly larger than those of the base 24, such that the flanged cover 28 fits over the shallow base 24 for covering the shallow base completely when the foldable pallet-mounted container 20 of the first preferred embodiment is in a collapsed form and is returned to a supplier for reuse for example. This feature prevents possible damage to the foldable container, which could occur during handling and transport of the folded container, especially when several containers are stacked on top of one another.

Figure 9:
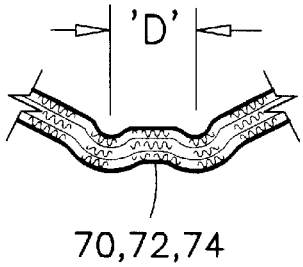
FIG. 9 is an enlarged plan view of the typical double-crease fold formed in a side panel of the container of the first preferred embodiment as seen in detail circle 9 in FIG. 5.

Referring back to FIGS. 1 and 2, the foldable box 26 of the pallet-mounted container of the first preferred embodiment is made of two side panels 60,62 and two end panels 64,66. The side and end panels are made of a triple-ply corrugated board having a nominal thickness of about 0.5 inch (12 mm) and wherein the corrugations are aligned vertically when the foldable box is deployed. The two side panels 60,62 each has three vertical folds 70,72,74 and 70',72',74' in a central and end portions thereof respectively and are foldable inside the box as illustrated in FIG. 1. Each fold 70,72,74,70',72' or 74' in the side panels is preferably a double crease fold having a width 'D' of about 1-¼ inches (32 mm), as illustrated in FIG. 9. This feature is to prevent a deterioration of the folds when the foldable container of the first preferred embodiment is re-used many times.

Figure 4:
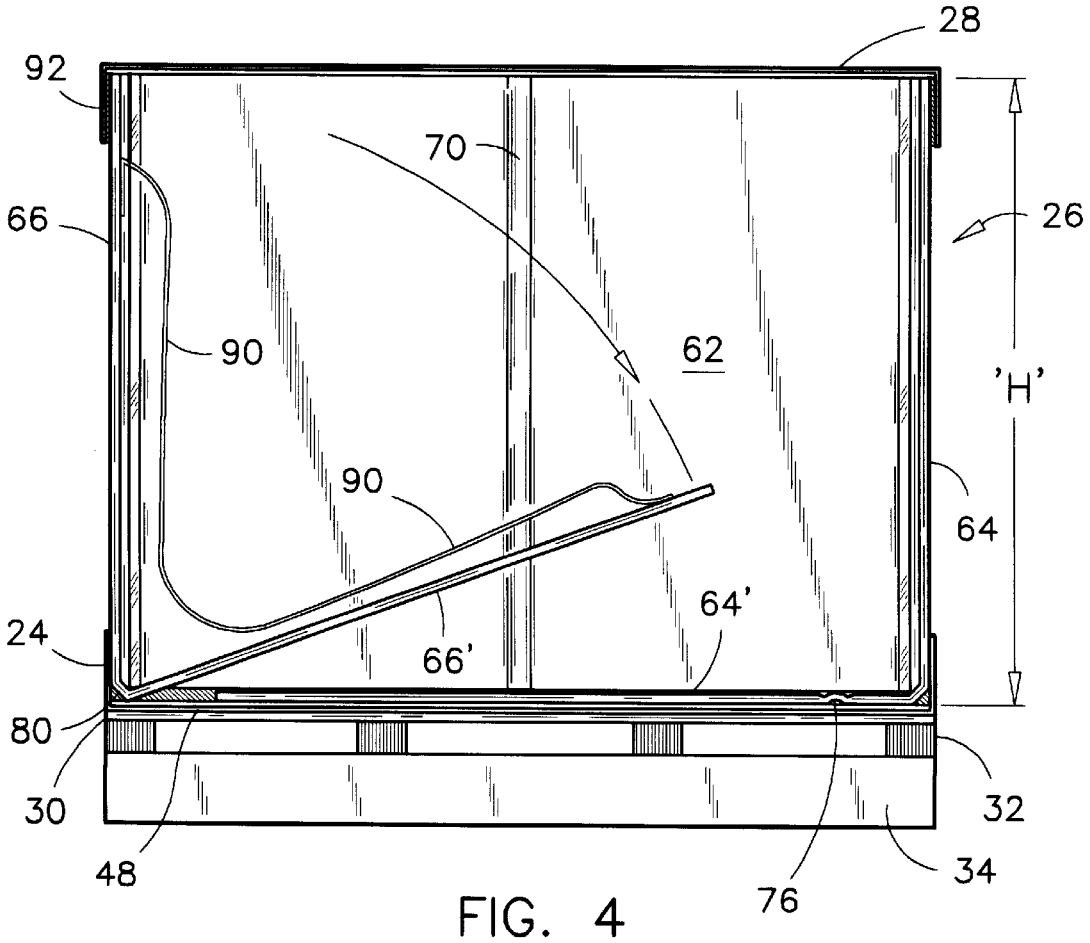
FIG. 4 is also a longitudinal cross-section view through the foldable pallet-mounted container of the first preferred embodiment, as seen from a same location as in FIG. 3, but with the foldable box in a fully deployed mode and the flanged cover installed thereon, such as would be seen along line 4—4 in FIG. 2.

With reference to FIG. 4, the first end panel 64, hereinafter referred to as the outside end panel, has an outside liner portion 64' extending therefrom and overlapping the inside horizontal surface 48 of the shallow base 24, and is glued to the inside surface 48 of the base 24. The second end panel 66, hereinafter referred to as the inside end panel has an inside liner portion 66' which is foldable inside the foldable box about a crease 80 along a lower edge of the foldable box, and toward and away from the inside end panel 66.

Figure 3:
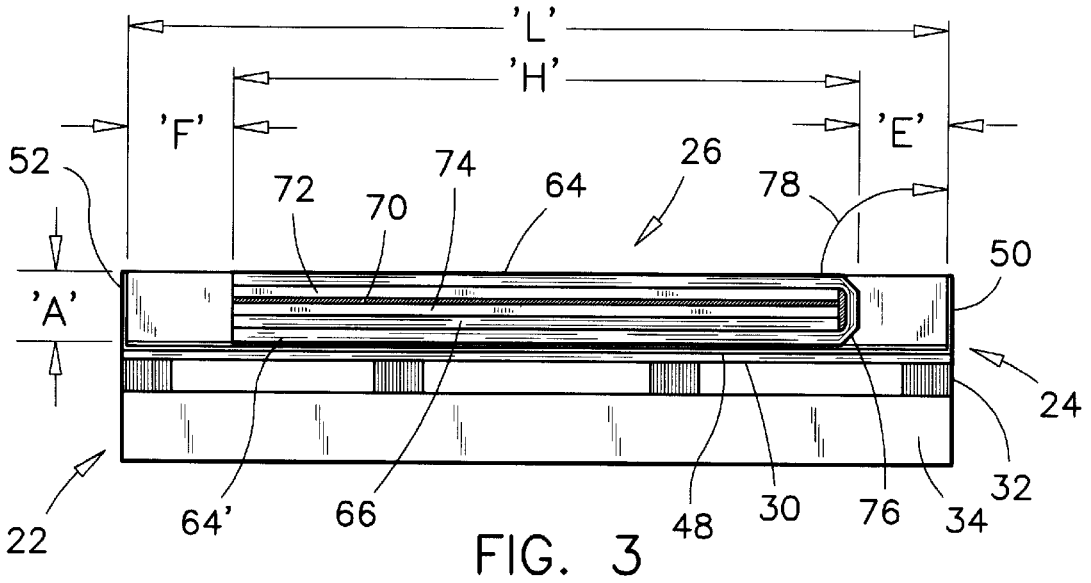
FIG. 3 is a longitudinal cross-section view through the foldable pallet-mounted container of the first preferred embodiment showing the foldable box in a collapsed mode inside the shallow base.

Referring now particularly to FIGS. 3 and 4, a longitudinal cross-section view of the foldable box 26 of the first preferred embodiment is shown therein with the box 26 in a folded mode and in a fully deployed mode respectively. The foldable box 26 is set inside the shallow base 24 to fold and unfold along the longitudinal direction of the base 24 as illustrated in FIG. 3. In that respect, the inside length 'L' of the shallow base 24 is longer than the height 'H' of the foldable box, by at least a first gap 'E', which is equivalent to the collapsed thickness of the foldable box 26. When the foldable box 26 is made of triple-ply corrugated board material as for the foldable box of the first preferred embodiment, the dimension of the first gap 'E' is between about 4-½ inches (11.4 cm) and about 5 inches (12.7 cm) and most preferably about 4-¾ inches (12 cm).

The first gap 'E' allows for the unfolding of the foldable box 26 about a first transversal crease 76 across the outside end panel 64–64', in a direction represented by arrow 78 in FIG. 3. After the foldable box 26 has been folded upwardly about crease 76 over an angular distance of 90°, the inside end panel 66 is movable longitudinally relative to the outside end panel 64 in order to extend the side panels 60,62 and to deploy the foldable box 26 fully as illustrated in FIGS. 2 and 4.

The minimum dimension of a second gap 'F' in the shallow base 24 as shown in FIG. 3 is preferably about one inch (2.5 cm) to facilitate the insertion of one's fingers therein to grasp an upper edge of the foldable box 26, and to tilt the foldable box 26 up from the shallow base 24, as described above. It will be appreciated, however, that the width of this second gap 'F' can be wider than one inch (2.5 cm) to accommodate foldable oblong boxes that have a length 'L' dimension which is greater than their height 'H'.

Common dimensions for the foldable box 26 of the preferred embodiments and the corresponding dimensions for gap 'F' are as follows, when making reference to FIGS. 3–6.

| Product # | Length 'L' | Width 'W' | Height 'H' | Gap 'F' |
|---|---|---|---|---|
| 001 | 44.75 in. (114 cm) | 32 in. (81 cm) | 34 in. (86 cm) | 6 in. (15 cm) |
| 002 | 46.5 in. (118 cm) | 46 in. (117 cm) | 40 in. (102 cm) | 1.5 in. (4 cm) |

When the foldable box 26 is fully deployed as illustrated in FIG. 4, the inside liner portion 66' is foldable downward against the outside liner portion 64'. The folding down of the inside liner portion 66' about the second transversal crease 80, pushes of the folds 70,70' in the side panels outwardly and prevents the side panels 60,62 from folding back in. When the inside liner portion 66' is overlapping the outside liner portion 64', the foldable pallet-mounted container of the first preferred embodiment has a bottom portion comprising, over a major area thereof, nine plies of corrugated board. This characteristic of the container of the first preferred embodiment is particularly advantageous for providing relatively large bending strength in the base of the container when supporting heavy fragmented loads inside the container 20.

There is also provided a string or strapping 90 connected to the inside liner portion 66' of the end panel and to the upper edge of the inside end panel 66. The strapping 90 is useful for lifting the inside liner portion 66' upwardly while standing near the inside end panel 66, and for allowing an easy folding of the foldable box 26. The lifting of the inside liner portion '66 and the folding of the box 26 is doable by one person initially standing near the inside end panel 66, by lifting the inside liner portion 66', by pushing the inside end panel 66 toward the outside end panel 64, and by folding the folded box 26 down against the bottom surface 48 of the shallow base 24, as will be described later when making reference to FIGS. 15–20.

The flanged cover 28 is then placed over the base 24 for protecting the shallow base 24 and the folded box 26 therein against damage during transport of the folded container 20 to the original filler of the container 20, or during handling and storage of the container 20.

Figure 6:
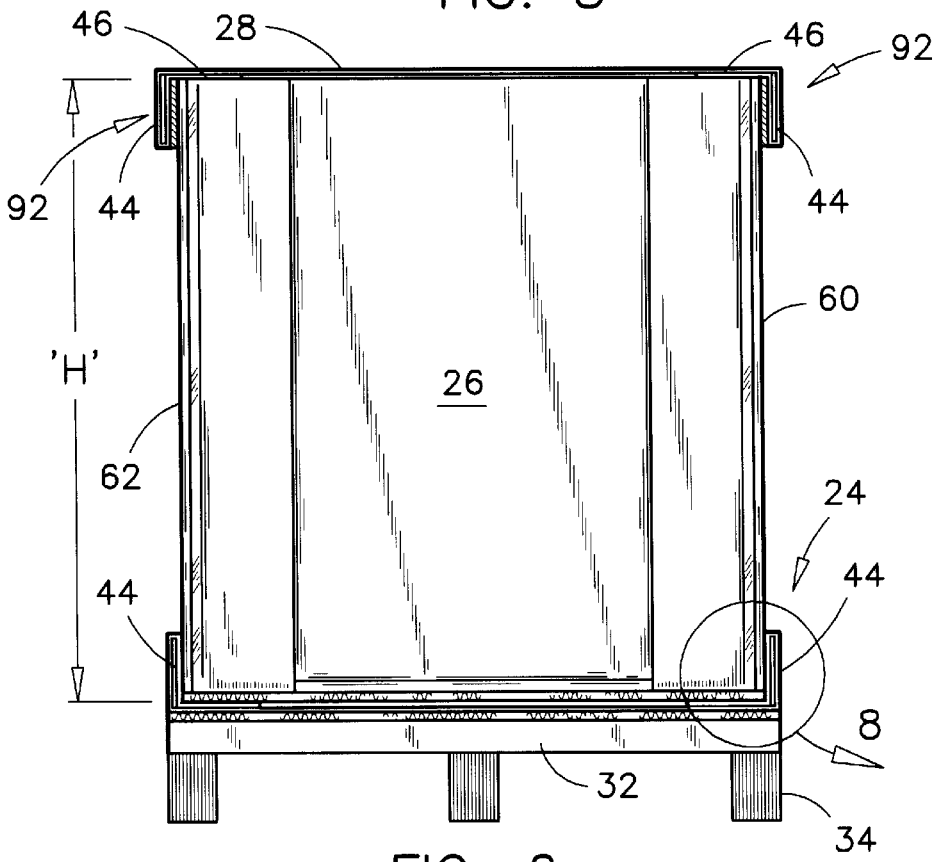
FIG. 6 is a transversal cross-section view through the foldable pallet-mounted container of the first preferred embodiment in a fully deployed mode, as seen along line 6—6 in FIG. 2.

Referring now to FIGS. 6 and 8, the deployed box 26 of the first preferred embodiment is particularly strong to resist transversal shear stresses therein, for being contained inside the pleats 44 and reinforcing flap members 46 of the shallow base 24, and inside the rim member 92 of the flanged cover 28.

Figure 5:
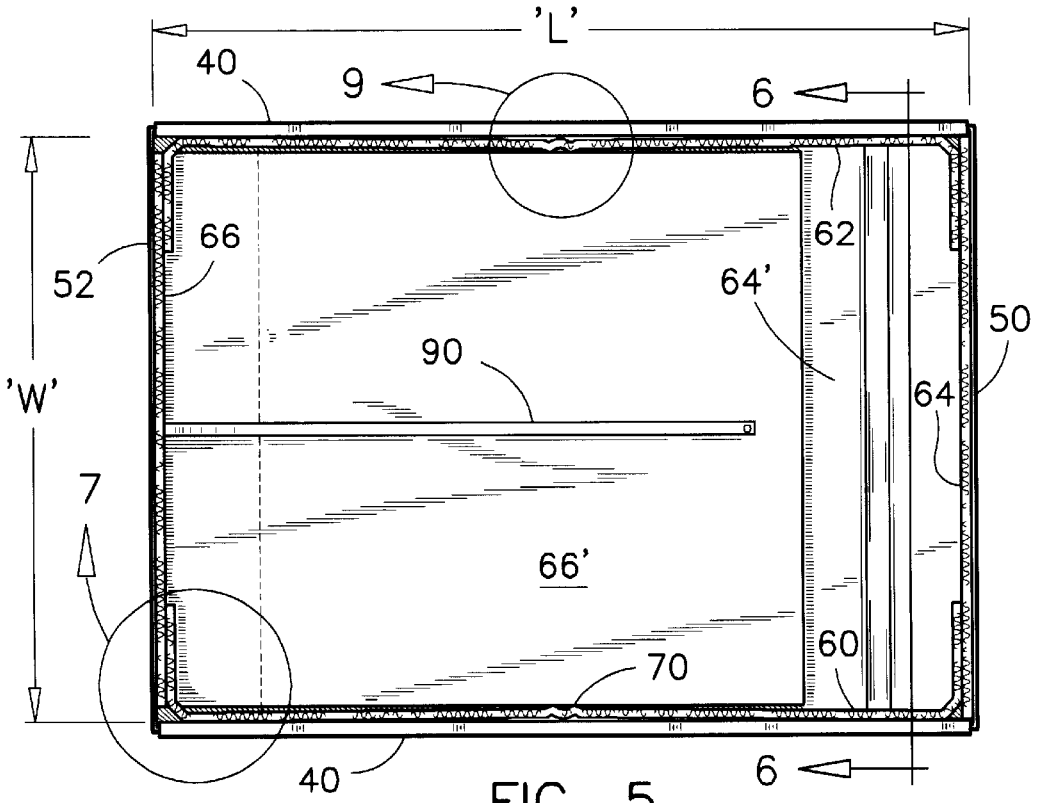
FIG. 5 is a plan view of the foldable pallet-mounted container of the first preferred embodiment without the cover.
Figure 7:
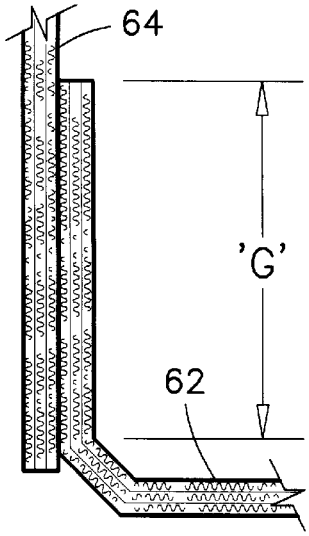
FIG. 7 is an enlarged view of a typical overlapping of a side panel of the foldable box over an end panel, as seen in detail circle 7 in FIG. 5.

When looking at FIGS. 4, 5 and 7, one will appreciate that the deployed box, and in particular the lower region thereof also has generous strength in a longitudinal direction, for having its end panels 64,66, connected to the inside and outside liner portions 64',66' which when the container is being used, are laid over top of one-another against the bottom surface 48 of the container and are covered, usually, by the material contained inside the container. Furthermore, the end panels 64,66 are connected to the side panels 60,62, by overlapping and gluing the side panels to the end panels as illustrated in FIGS. 5 and 7. The preferred overlapping distance 'G' is about 6 inches (15 cm) to ensure a strong bond between the sides and end panels and a good circumferential tensile strength of the foldable box 26 of the first preferred embodiment. The construction thus described is particularly advantageous for transporting material in bulk form or loose articles where horizontal shear strength in the container is required.

It will be appreciated that the configuration of the pallet 22 is not intended to constitute structural limitations to the present invention. The foldable container 20 of the first preferred embodiment may be used without the pallet 22, for mounting on a separate wooden pallet or plywood board for examples, or for mounting on a corrugated board pallet differing from the described pallet 22. The foldable container of the first preferred embodiment may also be used without a pallet, as a stationary container or otherwise. Such alternate embodiments are considered to be within the scope of the present invention wherein all the above-described advantages are nonetheless obtained.

Referring now to FIGS. 11–14, there is illustrated therein a second preferred embodiment of the present invention. The dimensions of the foldable pallet-mounted container of the second preferred embodiment 100 are similar to those of product no. 002 shown on a previous page. The operation of the foldable pallet-mounted container of the second preferred embodiment 100 does not differ substantially from the foldable pallet-mounted container of the first preferred embodiment 20. Slight variations in the structure of the second embodiment 100 are found in the pallet 120, in the shallow base 130 and in the construction of both the inside and outside end panel members 140,150.

The pallet 120 of the container of the second preferred embodiment is comprised of three runners 122 secured to the bottom surface of the shallow base 130. Here again, the pallet 120 is optional and the container 100 is usable without it. Each runner 122 is made of a plurality of corrugated board layers stacked side by side and the corrugations in each layer are aligned vertically. Each runner 122 has a width of about 4 inches (10 cm) and a height of about 3 inches (8 cm). The floor-contacting surface of each runner is covered by a single strip 124 of corrugated board laid against the edges of the plurality of layers described above.

Figure 14:
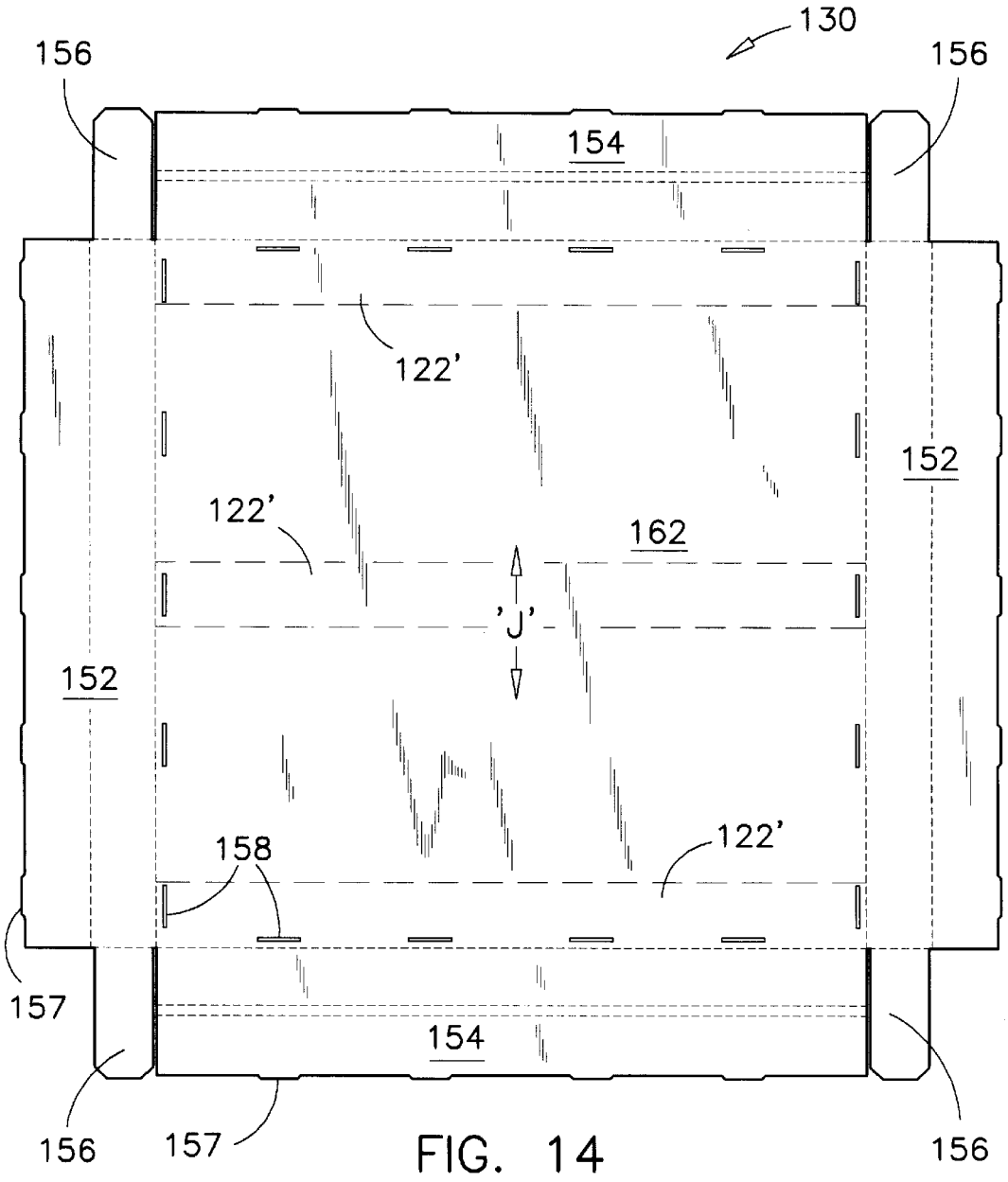
FIG. 14 is a flat pattern of the shallow base of the foldable pallet-mounted container of the second preferred embodiment.

The shallow base 130 of the foldable pallet-mounted container 100 of the second preferred embodiment is made of a single ply corrugated board. The alignment of the corrugations in the paperboard sheet of the shallow base 130 as indicated by label 'J' in FIG. 14 is transversal to the recommended placement of the runners as represented by labels 122' in FIG. 14. This arrangement provides greater stiffness to the bottom surface of the base 130 when the container is lifted by a forklift truck for example.

Figure 13:
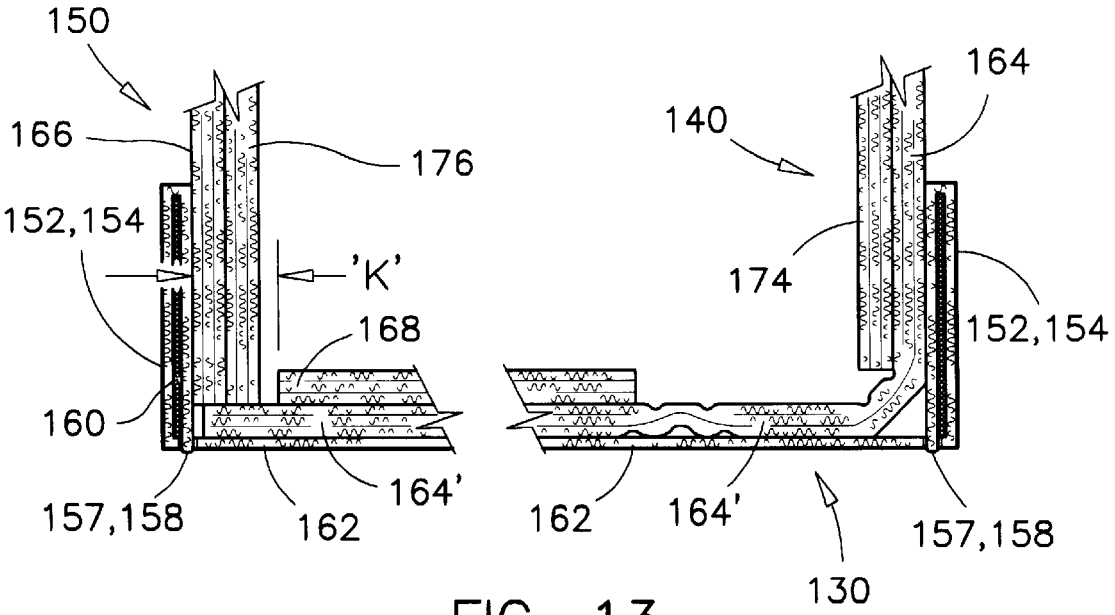
FIG. 13 is a cross-section view through the foldable pallet-mounted container of the second preferred embodiment as seen along line 13—13 in FIG. 12.

Referring particularly to FIGS. 13 and 14, the side members 152,154 of the shallow base 130 are folded over to form a double-ply arrangement defining a cavity 160 which has a same function as the pleat 44 as previously described, that is to receive and retain a tab 156 in each corner of the base 130 for interlocking the comers of the shallow base. The inside edge of each side member 152,154, has a series of tabs 157 thereon which are spaced apart and sized to be inserted into corresponding slots 158, in the bottom surface 162 of the shallow base for retaining the side members 152,154 in a folded mode as illustrated in FIG. 13.

The outside end member 140 of the foldable container of the second preferred embodiment is made of two layers 164,174 or 164,176 of corrugated board each having three plies. The outside end panel member 164 has an outside liner portion 164' extending over the bottom surface 162 of the base and is glued to the base 130, in a same way as the container of the first preferred embodiment 20. On top of the outside liner portion 164', there is provided an additional layer 168 of tripe-ply corrugated board glued to the outside liner portion 164', hereinafter referred to as the template member 168. The overall dimensions of the template member 168 are smaller than the inside dimensions of the shallow base 130, such that there is a gap 'K' of at least about one inch (2.5 cm) defined between the edges of the template member 168 and the sides 152,154 of the shallow base 130. When the foldable box portion 170 of the container of the second preferred embodiment is deployed, the lower edges of the foldable box portion 170 are inserted in the gap 'K' to retain the folds 172,172' of the box in a straight alignment and to retain the foldable box 170 in an opened configuration.

The foldable box portion 170 is made of two foldable panels 174,176 made of triple-ply corrugated board that are joined at vertical joints 178,180 on a respective end panel 140,150. The foldable panels 174,176 overlap the outside end panel member 164 and the inside end panel member 166 entirely. Both vertical joints 178,180 are diametrically opposite relative to the perimeter of the foldable box 170, such that both foldable panels 174,176 are symmetrical, easy to manufacture and easy to assemble.

Referring now to FIGS. 15–20, there is illustrated therein a preferred method for deploying and folding the foldable pal let-mounted container of the second preferred embodiment. It will be appreciated that this method also applies to a great extent, to the foldable pallet-mounted container of the first preferred embodiment.

Figure 15:
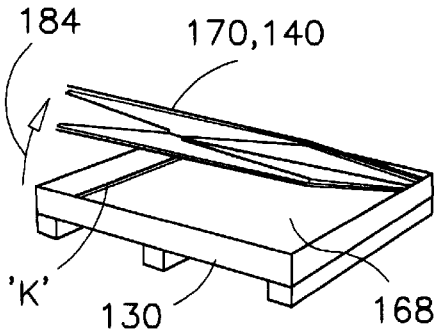
FIG. 15 is a perspective view of the foldable pallet-mounted container of the second preferred embodiment showing the foldable box being pulled out of the shallow base, thereby illustrating a first step in opening the container.
Figure 16:
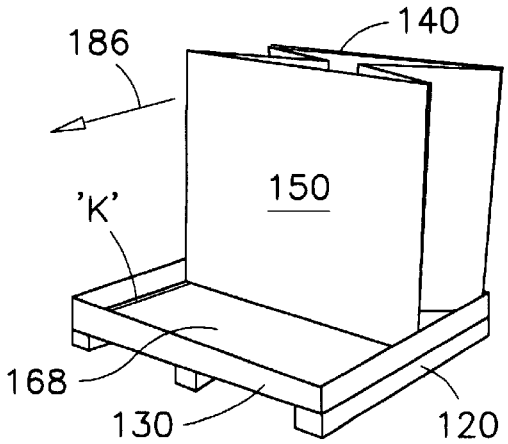
FIG. 16 is a perspective view of the foldable pallet-mounted container of the second preferred embodiment showing the folded wall-forming portion being extended into an open position, thereby illustrating a second step in opening the container.
Figure 17:
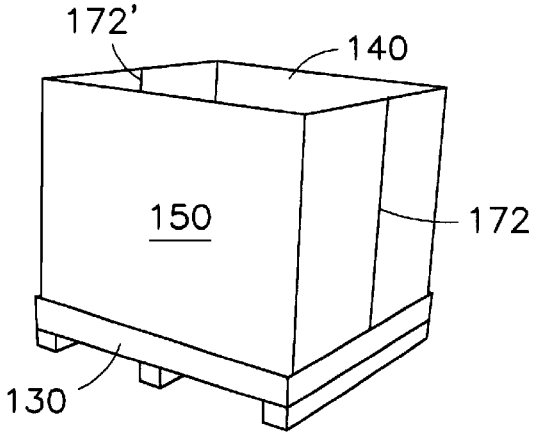
FIG. 17 is a perspective view of the foldable pallet-mounted container of the second preferred embodiment showing the foldable box is a fully deployed mode.
Figure 18:
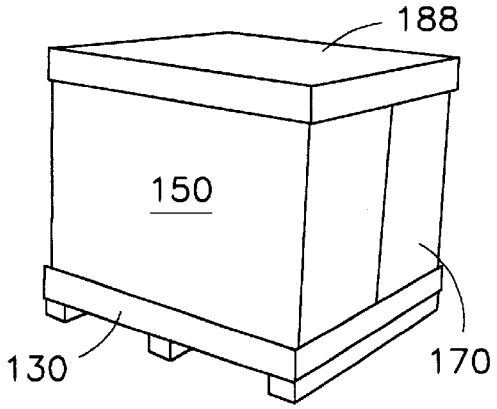
FIG. 18 is a perspective view of the foldable pallet-mounted container of the second preferred embodiment in a fully deployed mode with a flanged cover mounted thereon.

Starting with FIG. 15, the foldable box 170 is tilted upwardly from the shallow base 130, about the lower edge of the outside end panel 140, in a direction represented by arrow 184. The angle of tilting the container is substantially a right angle, or slightly more, one or two degrees for example, to allow the inside end panel 150 to slide over the template member 168 covering the bottom surface of the shallow base 130. The inside end panel 150 is then pulled away from the outside end panel 140 in a direction indicated by arrow 186, to cause the folds 172,172' to stretch and align straight. When the box 170 is fully stretched, the lower edges of the box drop into the gap 'K' around template member 168, such that the box remains in an opened configuration as shown in FIG. 17. A flanged cover 188 is then placed over the open side of the box to protect the content of the foldable box 170.

Figure 19:
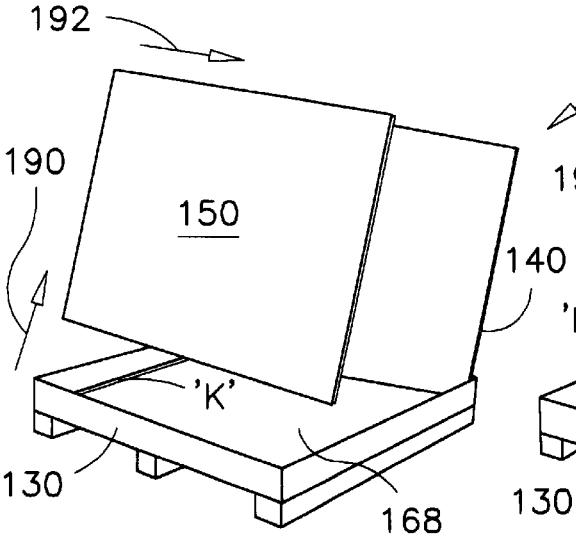
FIG. 19 is a perspective view of the foldable pallet-mounted container of the second preferred embodiment with one end of the foldable box being lifted up, thereby illustrating a first step in folding the container.
Figure 20:
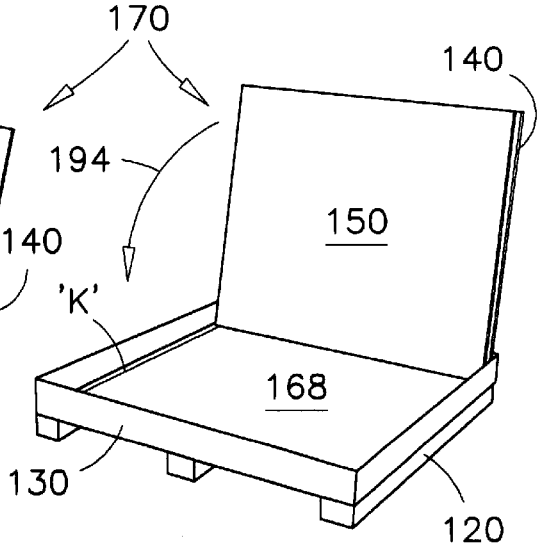
FIG. 20 is a perspective view of the foldable pallet-mounted container of the second preferred embodiment with the foldable box in a collapsed mode prior to folding it down into the shallow base, thereby illustrating a second step in folding the container.

The folding of the container prior to storing it or sending it back to the original filler for example is initiated by slightly lifting the foldable box 170 and tilting it about the lower edge of the outside end panel 140 as indicated by arrow 190 in FIG. 19, and pushing the inside end panel 150 against the outside end panel 140, as indicated by arrow 192. When the inside end panel 150 is folded against the outside end panel 140, the folded box 170 may then be tilted down into the shallow base 130 in a direction as indicated by arrow 194 in FIG. 20, with the inside end panel 150 laying against the template member 168. The folded box 170 and shallow base 130 are then preferably covered with the flanged cover 188 for protecting the folded box 170 during shipment and storage, especially when two or more foldable containers are stacked over one-another. The methods described above for deploying or folding the container of the second preferred embodiment are easily effected by one person while standing near the foldable container. This person does not have to reach under the base 130 or otherwise manipulate the pallet 120.

The method described above does not require detailed instruction or much training to teach a new user how to deploy one of the containers of the preferred embodiments. The resiliency of the folds 172,172' forces the folded box 170 to open as soon as the folded box reaches an upward position. A further pulling on the extendible end 150 of the box causes the lower edge of the box to fall into the gap 'K' around the template member 168, thereby keeping the box from folding back. For the foldable container of the first preferred embodiment, the pulling on the extendible end 66 of the box causes the inside liner portion 66' to fall down, thereby preventing the box from folding back in. Once a person has deployed one of the foldable containers of the preferred embodiments, it is relatively easy for that person without having recourse to written instruction, to reverse the above procedure and to fold the container back into a collapsed mode.

Figure 21:
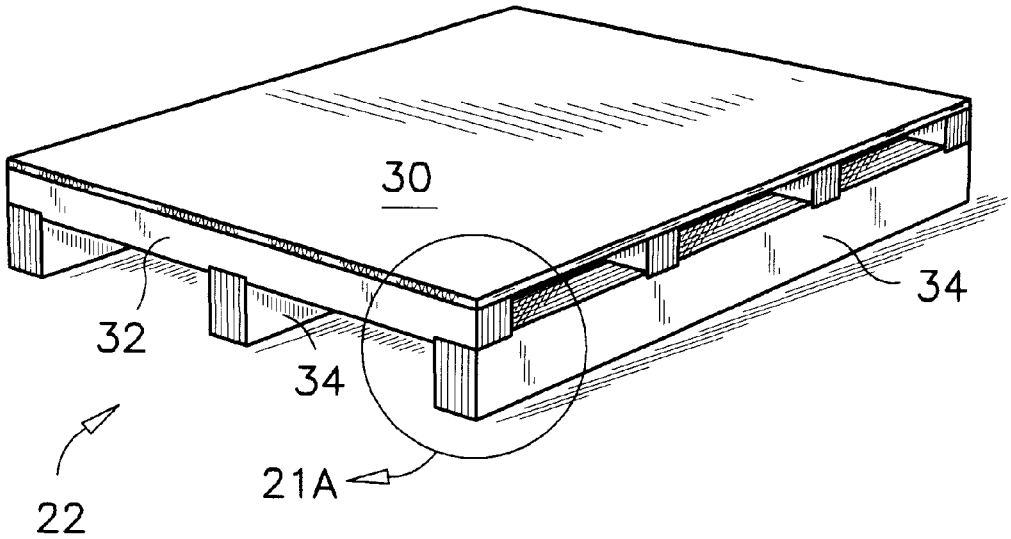
FIG. 21 is a perspective view of the pallet used with the foldable pallet-mounted container of the first preferred embodiment.
Figure 21A:
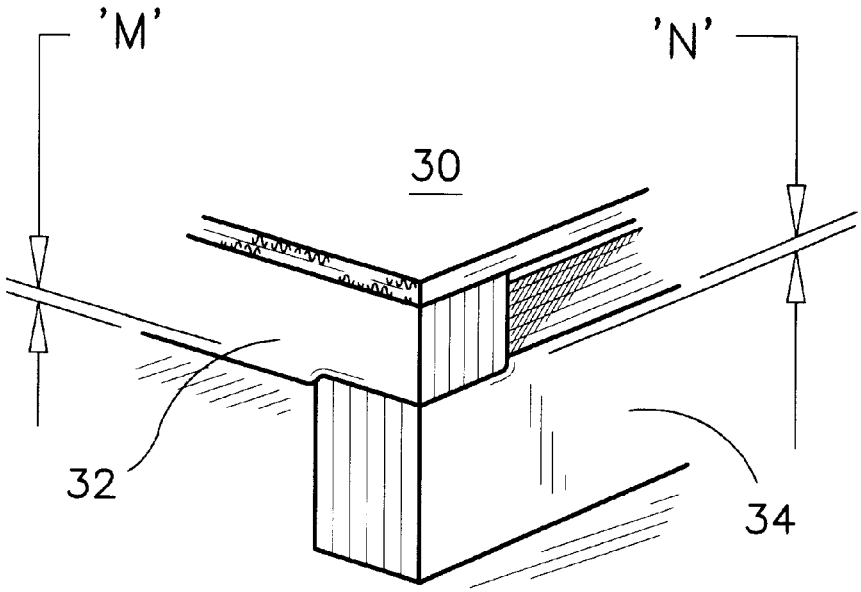
FIG. 21A is an enlarged view of the interlocking of a rail and a runner in the pallet illustrated in FIG. 21, as shown in detail circle 21A in FIG. 21.

Referring now to FIGS. 21 and 21A the pallet 22 mounted under the foldable pallet-mounted container of the first preferred embodiment is illustrated therein in order to describe an important structural characteristic thereof. As it was mentioned earlier, this pallet 22 as well as the foldable containers of the first and second preferred embodiments are manufactured with a water-based pulpal glue. The preferred glue is a type known in the industry under the tradename of SWIFT 47206™ manufactured by or for Reichhold Chemicals, Inc. of P.O. Box 13582, Research Triangle Park, N.C., 27709, U.S.A. The glueing process is a cold process wherein the glue is applied and the curing is done at ambient temperature.

The gluing of the runners 32 to the rails 34 is done under sufficient pressure to interlock the runners 32 and the rails 34 together. Sufficient pressure means a pressure that can cause a deformation 'M' in the runners 32 and a deformation 'N' in the rails 34 of about ⅛ inch (3 mm) in each surface, such that the interlocking engagement is a stress-related, mutually-induced double deformations having a total depth of at least about ¼ inch (6 mm). This type of interlocking engagement has been found to be advantageous for providing superior shear and bending strength in the pallet of the preferred embodiment, as compared to conventional corrugated board pallets. As an example, conventional corrugated board pallets have a typical loading capacity of about 500 lbs. (227 kg) in racking mode, that is supported on both outside rails only. The pallet of the preferred embodiment 22 with the described interlocking engagement and the specified adhesive has a capacity in racking node of 2200 lbs. (1000 kg). This feature is also appreciable for providing a pallet 22 with greater lateral or diagonal compression strength, better resistance to shocks and rough handling and a longer useable life as compared to the conventional corrugated board pallets.

While the preferred embodiments of this invention were described as being made of corrugated board, other materials are also contemplated by the inventor of the present invention, and are considered to be within the scope of this invention. For examples, it is believed that the foldable containers and pallets of the present invention and similar structures embodying the innovative features described herein can be manufactured with materials such as paperboard, cardboard, fiberboard, wood board, plastic sheet, plastic moulding, fiberglass, plywood, pressed wood, sheet metal, fabric or similar flexible material mounted over a rigid frame or similar materials or similar composite structures. It will also be appreciated that various modifications, alternate construction and equivalents may also be employed without departing from the true spirit and scope of the invention. Therefore, the above description and accompanying illustrations should not be construed as limiting the scope of the invention which is defined by the appended claims.

I claim:

1. A foldable container comprising:

a shallow base having a longitudinal orientation, a transversal orientation, a horizontal bottom member having four straight edges at right angle with each other, four uprising side members respectively connected to one of said four straight edges, and two reinforcing flap members, each being connected to one of said uprising side members along said longitudinal orientation and overlapping said bottom member along a full length of said bottom member;

a foldable box mounted inside said shallow base; said foldable box having:

first and second spaced-apart end panels extending across said longitudinal orientation and each having a lower portion adjacent said shallow base;

first and second spaced-apart side panels extending across said transversal orientation; each of said first and second spaced-apart side panels having three folds therein, and two of said folds in each of said side panels being hingedly connected to said first and second end panels respectively, said first and second spaced-apart side panels being foldable about said folds toward each other; and first and second liner members laid over each other and over said bottom member of said shallow base; said first liner member overlapping a major surface of said reinforcing flap members and a major surface of said bottom member, and said second liner member overlapping a major surface of said first liner member; said first liner member being affixed to said bottom member and hingedly connected to said lower portion of said first end panel; said second liner member being hingedly connected to said lower portion of said second end panel and being foldable between a deployed position laid against said first liner member and a folded position laid against said second end panel;

such that said first and second liner members cooperate with each other, with said reinforcing flaps and with said bottom member for simultaneously reinforcing said shallow base, for reinforcing a lower portion of said foldable box and for retaining said foldable box inside said shallow base for preventing a separation of said foldable box from said shallow base when said foldable box is adapted to contain material, while maintaining a folding ability of said foldable box when said foldable box is empty.

2. The foldable container as claimed in claim 1, wherein a width of said second liner member is substantially similar to a width of said first and second end panels for acting against said folds in said side panels when said second liner member is in said deployed position, and for maintaining said foldable box opened.

3. The foldable container as claimed in claim 1, further comprising a strap member connected to an upper portion of said second end panel and to said second liner member for selectively moving said second liner member between said deployed position to said folded position.

4. The foldable container as claimed in claim 1, wherein a width of each said reinforcing flap members is about 4¾ inches.

5. The foldable container as claimed in claim 1, wherein each said folds is a double crease fold having a width of about 1-¼ inches.

6. The foldable container as claimed in claim 1, wherein a height of each said uprising side members is about 4¾ inches.

7. The foldable container as claimed in claim 1, wherein said first and second side panels, said first and second end panels, and said first and second liner members are made of triple-ply corrugated board material.

8. The foldable container as claimed in claim 1, further comprising a flanged cover mounted over said foldable box.

9. The foldable container as claimed in claim 8, wherein said flanged cover has a structure which is similar to a structure of said shallow base.

10. The foldable container as claimed in claim 1, wherein said first end panel is integral with said first liner member and is foldable relative to said first liner member about a first horizontal crease in said lower portion of said first end panel.

11. The foldable container as claimed in claim 10, wherein said second liner member is integral with said second end panel and is foldable relative to said second end panel about a second horizontal crease in said lower portion of said second end panel.

12. The foldable container as claimed in claim 1, further comprising a pallet mounted under said shallow base.

13. The foldable container as claimed in claim 12, wherein said shallow base is made of corrugated board material and said pallet is made of a plurality of runners fabricated with laminated corrugated board strips, and glued to an underside of said horizontal bottom member.

14. The foldable container as claimed in claim 13, wherein said runners are oriented transversally to the corrugations in said horizontal bottom member.

15. The foldable container as claimed in claim 14, wherein said horizontal bottom member of said shallow base comprises three plies of corrugated board.

16. A foldable container comprising:

a base having a base surface and a foldable box mounted on said base surface, said foldable box comprising:

first and second spaced-apart end panels each having a lower portion adjacent said base surface;

first and second spaced-apart side panels each having three folds therein, and two of said folds in each said side panels being hingedly connected to said first and second end panels respectively, said first and second spaced-apart side panels being foldable about said folds toward each other; and first and second liner members laid over each other and over said base surface, and forming a bottom of said foldable box; said first liner member being affixed to said base surface and hingedly connected to said lower portion of said first end panel; said second liner member being hingedly connected to said lower portion of said second end panel and being foldable between a deployed position laid against said first liner member and a folded position laid against said second end panel;

such that said first and second liner members cooperate with each other and with said base surface, for enhancing a strength of said base surface and for retaining said first and second end panels of said foldable box against said base surface when said foldable box is deployed and is adapted to contain material, while maintaining a folding ability of said foldable box when said foldable box is empty.

17. The foldable container as claimed in claim 16, further comprising a strap member connected to an upper portion of said second end panel and to said second liner member for selectively moving said second liner member between said deployed position to said folded position.

18. The foldable container as claimed in claim 16, wherein a width of said second liner member is substantially similar to a width of said first and second end panels for acting against said folds when said second liner member is in said deployed position and for maintaining said foldable box opened.

19. The foldable container as claimed in claim 16, wherein said first end panel is integral with said first liner member and is foldable relative to said first liner member about a first horizontal crease in said lower portion of said first end panel, and said second liner member is integral with said second end panel and is foldable relative to said second end panel about a second horizontal crease in said lower portion of said second end panel.

20. The foldable container as claimed in claim 19, further comprising a pallet mounted under said base.

* * * * *